US012270272B2

(12) United States Patent
Alhaqbani

(10) Patent No.: US 12,270,272 B2
(45) Date of Patent: Apr. 8, 2025

(54) GROUND-LEVEL PLUG AND PERF BALL DROP TOOL

(71) Applicant: SAUDI ARABIAN OIL COMPANY, Dhahran (SA)

(72) Inventor: Mohammed Abdullateef Alhaqbani, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 10 days.

(21) Appl. No.: 18/459,761

(22) Filed: Sep. 1, 2023

(65) Prior Publication Data

US 2025/0075581 A1 Mar. 6, 2025

(51) Int. Cl.

| | |
|---|---|
| ***E21B 33/068*** | (2006.01) |
| ***E21B 23/08*** | (2006.01) |
| ***E21B 33/05*** | (2006.01) |
| ***E21B 33/16*** | (2006.01) |
| ***E21B 34/02*** | (2006.01) |
| ***E21B 43/26*** | (2006.01) |

(52) U.S. Cl.
CPC ..... *E21B 33/068* (2013.01); *E21B 43/2607* (2020.05)

(58) Field of Classification Search
None
See application file for complete search history.

(56) References Cited

U.S. PATENT DOCUMENTS

| | | | | |
|---|---|---|---|---|
| 2,790,500 | A * | 4/1957 | Jones | E21B 33/068 15/104.062 |
| 2,955,654 | A * | 10/1960 | Stogner | E21B 33/068 166/177.5 |
| 2,961,046 | A * | 11/1960 | Moeller | E21B 33/068 15/104.062 |
| 3,011,196 | A * | 12/1961 | Glover | F16L 55/46 15/104.062 |
| 4,759,469 | A * | 7/1988 | Lowrance | B65G 33/04 29/889 |
| 6,491,116 | B2 | 12/2002 | Berscheidt et al. | |
| 7,281,589 | B2 | 10/2007 | Robichaux et al. | |
| 8,869,882 | B2 * | 10/2014 | McGuire | B65D 83/0409 15/104.062 |
| 9,010,413 | B2 | 4/2015 | Artherholt et al. | |
| 9,109,422 | B2 | 8/2015 | Ferguson et al. | |
| 9,228,417 | B2 | 1/2016 | McGuire et al. | |

(Continued)

FOREIGN PATENT DOCUMENTS

| | | | |
|---|---|---|---|
| CA | 2952200 | A1 | 2/2013 |
| EP | 2951436 | B1 | 12/2015 |

*Primary Examiner* — Matthew Troutman
*Assistant Examiner* — Douglas S Wood
(74) *Attorney, Agent, or Firm* — Vorys, Sater, Seymour and Pease, LLP

(57) ABSTRACT

A projectile introduction system includes a central pipe configured to receive and guide a wellbore projectile therethrough, a ball guide mated to a top end of the central pipe, including sloped surfaces for guiding the wellbore projectile into the central pipe, a T-shaped joint including connections on opposing arms and in fluid communication with a bottom end of the central pipe, and at least one high-pressure line extending between a pump and a wellbore frac tree, wherein the connections on the opposing arms of the T-shaped joint are mated with the at least one high-pressure line.

20 Claims, 3 Drawing Sheets

(56) References Cited

U.S. PATENT DOCUMENTS

| | | | | |
|---|---|---|---|---|
| 9,260,933 | B2 | 2/2016 | Artherholt et al. | |
| 9,739,111 | B2 | 8/2017 | Beason et al. | |
| 10,208,556 | B2 | 2/2019 | Barbee et al. | |
| 10,378,302 | B2 | 8/2019 | Sinkewich et al. | |
| 10,731,436 | B2 * | 8/2020 | Allen | E21B 34/02 |
| 10,801,300 | B2 | 10/2020 | Saeed | |
| 2006/0054326 | A1 * | 3/2006 | Alves | E21B 33/068 166/310 |
| 2013/0175053 | A1 | 7/2013 | Madero et al. | |
| 2014/0166265 | A1 | 6/2014 | Artherholt et al. | |
| 2014/0262302 | A1 * | 9/2014 | Ferguson | E21B 33/068 166/318 |
| 2017/0051572 | A1 * | 2/2017 | Penney | E21B 23/08 |
| 2018/0119521 | A1 | 5/2018 | Silva | |
| 2018/0230765 | A1 | 8/2018 | Crump et al. | |
| 2019/0301261 | A1 * | 10/2019 | Anthony | E21B 33/068 |
| 2019/0360296 | A1 | 11/2019 | Pedraza et al. | |
| 2020/0056440 | A1 | 2/2020 | Golinowski | |
| 2020/0056442 | A1 * | 2/2020 | Cherewyk | E21B 17/1078 |
| 2020/0284144 | A1 | 9/2020 | Andreychuk et al. | |
| 2020/0332618 | A1 * | 10/2020 | Eitschberger | E21B 23/08 |

* cited by examiner

GROUND-LEVEL PLUG AND PERF BALL DROP TOOL

FIELD OF THE DISCLOSURE

The present disclosure relates generally to hydraulic fracturing equipment and, more particularly, to a tool for inserting a drop ball or other projectile into a hydraulic fracturing system, e.g., to seal a frac plug used in plug and perf operations.

BACKGROUND OF THE DISCLOSURE

Many techniques have been developed for the extraction of hydrocarbons from unconventional reservoirs. These techniques include hydraulic fracturing or steam injection for facilitating hydrocarbon flow. One of the most successful techniques employed in unconventional reservoirs is the "plug and perf" technique. Plug and perf techniques utilize downhole plugs, or "frac plugs", to isolate one or more sections of a wellbore and subsequently perforate the isolated section. The isolated sections may then be hydraulically fractured to stimulate hydrocarbon production from the surrounding reservoir. Many frac plugs employed in plug and perf operations are placed downhole in an open state, such that fluid can pass through the frac plugs prior to beginning the hydraulic fracturing operation. In these cases, a wellbore projectile, or "drop ball" may be introduced to the hydraulic fracturing equipment and pumped into wellbore and, upon reaching the frac plug, may complete the frac plug seal.

The drop ball is often introduced via the wellhead. Due to the high pressures involved in hydraulic fracturing, a structure of wellhead valves commonly referred to as a "frac tree" or a "Christmas tree," is often installed above the wellhead to control the flow of fluids into and out of the wellbore. The Christmas tree is often arranged in a vertical structure which may extend 15 feet or more above a ground surface. In conventional plug and perf operations, the Christmas tree may be modified to mate with a ball drop apparatus on top of the Christmas tree for introducing drop balls to the wellbore. The vertical implementation of the ball drop apparatus may require the use of cranes, manlifts, wellhead platforms or other lifting equipment for operation and maintenance. The use of lifting equipment can be interrupted by inclement weather, situational hazards, and can create inconvenient and unsafe conditions for wellhead operators.

Accordingly, a ball drop apparatus which enables ground-level operation without necessitating the use of lifting equipment is desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a projectile introduction system includes a central pipe configured to receive and guide a wellbore projectile therethrough, a ball guide mated to a top end of the central pipe, including sloped surfaces for guiding the wellbore projectile into the central pipe, a T-shaped joint including connections on opposing arms and in fluid communication with a bottom end of the central pipe, and at least one high-pressure line extending between a pump and a wellbore frac tree, wherein the connections on the opposing arms of the T-shaped joint are mated with the at least one high-pressure line.

In a further embodiment, a method includes mating one or more high-pressure lines extending between a pump and a frac tree to a T-shaped joint of a ball drop apparatus at ground level, inserting a wellbore projectile into a ball guide in communication with a central pipe of the ball drop apparatus, introducing the wellbore projectile into the high-pressure lines through the central pipe and the T-shaped joint, and inserting the wellbore projectile into the frac tree via the high-pressure lines and a fracturing head of the frac tree.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
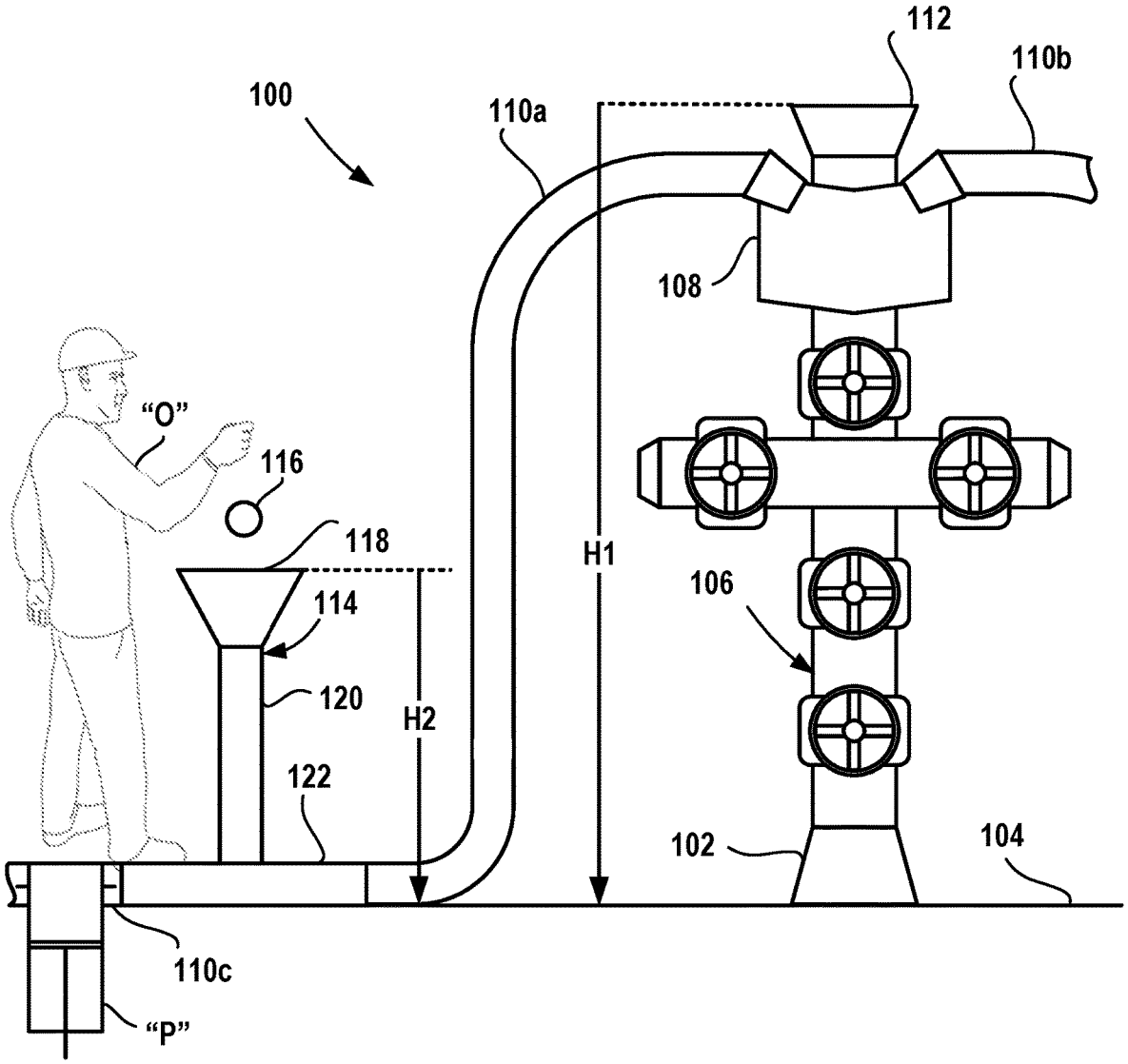
FIG. 1 is a schematic view of an example projectile introduction system that includes a ball drop apparatus operable from ground-level in accordance with principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to hydraulic fracturing equipment and, more particularly, to a ball drop apparatus for use in plug and perf operations at ground level. Embodiments disclosed herein may include a ball drop apparatus for introduction of a wellbore projectile to hydraulic fracturing equipment and then into a wellbore from ground level. The ball drop apparatus may include a support frame, a projectile storage component, a power source, and one or more motors for accelerating the wellbore projectile within the ball drop apparatus. The ball drop apparatus may further include one or more gate valves, which may be closed for preventing flow through the ball drop apparatus, e.g., during high pressures encountered during pumping of the main treatment fluid. The gate valves may be closed to allow pumping the stage, and pumped fluid will carry the ball to the frac plug. Further embodiments disclosed herein may include a method for introducing a wellbore projectile into a wellbore from ground level. The apparatus and method for introducing a wellbore projectile at ground level may increase safety and simplicity of plug and perf operations at least since lifting equipment is obviated, thus removing possible hazards and downtime due to weather or malfunction.

FIG. 1 is a schematic view of an example projectile introduction system 100 that incorporates the principles of the present disclosure. The projectile introduction system 100 (hereafter "the system 100") may include a wellhead 102 installed at a well surface location 104 and assembled as a means of containing fluid pressure within a wellbore (not shown) extending from the wellhead 102. The fluid within the wellbore may be regulated by a frac tree 106, which includes a series of valves, spools, and fittings installed on the wellhead 102. The frac tree 106, sometimes referred to as a "Christmas tree," is used to control the flow of fluids and components in and out of the wellbore.

In the present disclosure, the frac tree 106 may be installed over an unconventional reservoir, such that hydraulic fracturing may be utilized for hydrocarbon extraction. Accordingly, the frac tree 106 may include a fracturing head 108. The fracturing head 108 may include a flow cross installed near a top of the frac tree 106, which allows additional conduits to be connected to provide fracturing fluid to the frac tree 106.

The fracturing head 108 may be in fluid communication with both the remainder of the frac tree 106 and one or more high-pressure lines 110*a,b*. In some embodiments, the high-pressure lines 110*a,b* may be components of a fracturing fleet, which may include additional rigs, trucks, pumps, or equipment utilized in fracturing operations. The high-pressure lines 110*a,b* may deliver hydraulic fracturing fluid from a pump "P" at high pressures to the fracturing head 108 for the performance of hydraulic fracturing in the wellbore.

The frac tree 106 may additionally include a receiver 112 at a top or upper end of the frac tree 106, such that further equipment (not shown) may be mounted atop the frac tree 106. In some embodiments, the further equipment may include, for example, a wireline injector used for deploying perforating guns and other completion equipment into the wellbore. In conventional systems, the receiver 112 may also accommodate a drop ball injector for introducing a wellbore projectile into the wellbore. However, a height H1 of the frac tree 106 may require additional equipment, such as cranes or manlifts for installation and operation of such a drop ball injector, which may create hazardous conditions and are prone to weather interruptions and technical difficulties.

According to embodiments of the present disclosure, the system 100 includes a ball drop apparatus 114 accessible by an operator "O" at ground-level to facilitate manual operation. The ball drop apparatus 114 has a height H2 above ground level, e.g., above the well surface location 104. The height H2 is less than the height H1 of the frac tree 106, and may be readily accessed by the operator "O" standing on the well surface location 104. In some embodiments, the height H2 may be in the range of about 1 foot to about 6 feet, and preferably in the range of about 3 feet to about 4 feet. In some embodiments, as illustrated, the ball drop apparatus 114 may be in fluid communication with the high-pressure line 110*a*, between the pump "P" and the fracturing head 108, for introduction of a wellbore projectile 116 into the wellbore.

The ball drop apparatus 114 may include a ball guide 118 which may be configured to receive the wellbore projectile 116 from the operator "O". The ball guide 118 may facilitate entry of the wellbore projectile 116 into a central pipe 120 of the ball drop apparatus 114, which extends in a generally vertical downward direction from the ball guide 118. The central pipe 120 of the ball drop apparatus 114 may terminate in a T-shaped joint 122, such that a wellbore projectile 116 dropped through the central pipe 120 will enter the joint 122. The joint 122 may be in fluid communication with the high-pressure line 110*a* in order to receive and transport the wellbore projectile 116 from the joint 122 to the frac tree 106.

The joint 122 may be further in communication with a high-pressure line 110*c* extending between the pump "P" and the joint 122 such that the joint 122 may receive high-pressure fracturing fluids from the pump "P". In some embodiments, the central pipe 120 and the joint 122 may be formed of three-inch outer diameter pipe in order to mate with the high-pressure lines 110*a-c* often employed for wellbore fracturing operations. The wellbore projectile 116 may accordingly be introduced to the frac tree 106 via the ball drop apparatus 114 and the high-pressure line 110*a*, such that the wellbore projectile 116 may travel through the frac tree 106 and wellbore towards a fracturing plug or other downhole tooling.

Figure 2:
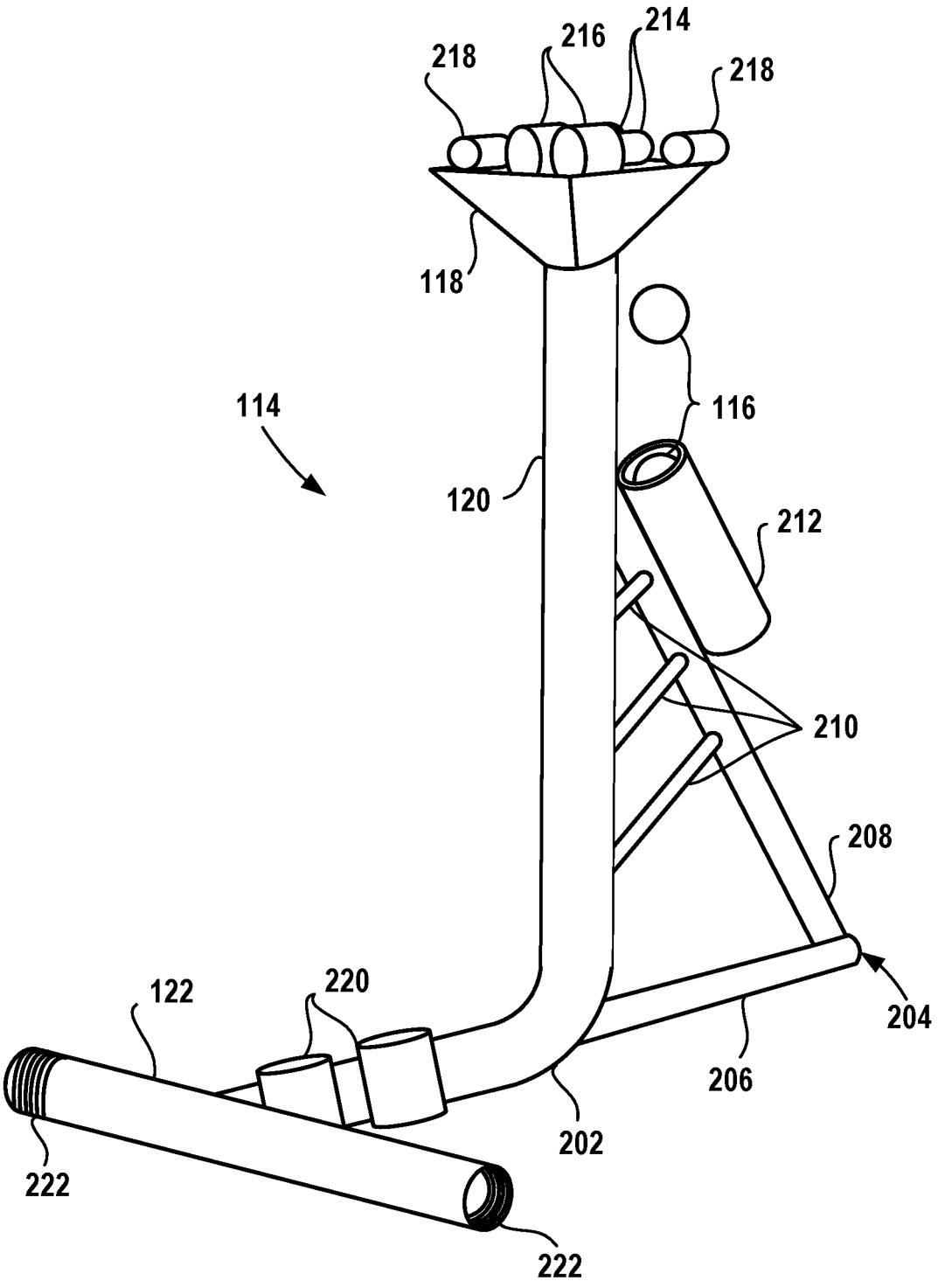
FIG. 2 is a schematic view of the ball drop apparatus of FIG. 1, according to at least one embodiment of the present disclosure.

FIG. 2 is a schematic view of the ball drop apparatus 114, according to at least one embodiment of the present disclosure. As illustrated, the central pipe 120 may further include an elbow 202, which may transition the central pipe 120 from a generally vertical orientation to a generally horizontal orientation. In some embodiments, the elbow 202 may enable additional acceleration of the wellbore projectile 116 as it traverses the central pipe 120, while further enabling increased spacing of the central pipe 120 to include additional components of the ball drop apparatus 114, e.g., the gate valves 220 described below.

The ball drop apparatus 114 may be positioned upright, as shown, such that the elbow 202 rests at or near ground level. The ball drop apparatus 114 may further include a support frame 204 configured to enable increased stability of the ball drop apparatus 114 at the ground level. The support frame 204 may include a lateral bar 206 protruding from the elbow 202 to increase a surface area of the ball drop apparatus 114 in contact with the ground. The support frame 204 may further include an angled bar 208 connected at or near an end of the lateral bar 206 and to a generally vertical section of the central pipe 120. In some embodiments, the support frame 204 may include one or more cross bars 210 which further connect the central pipe 120 with the angled bar 208. The cross bars 210 may further increase stability of the support frame 204 and the ball drop apparatus 114, thus preventing undesirable motion of the ball drop apparatus 114 during operation.

In some embodiments, a projectile storage compartment 212 may be mated to the angled bar 208 near a point of connection with the central pipe 120. The projectile storage compartment 212 may be configured to receive and store a plurality of wellbore projectiles 116 for use in downhole operations. The projectile storage compartment 212 may be formed of a rigid material, such as a metal, a high-temperature plastic, or wood, such that the projectile storage compartment 212 may be thermally stable for use in high-temperature environments without overheating or deforming.

As discussed above, the ball guide 118 may be mounted or otherwise attached to an upper end of the central pipe 120 for guiding a wellbore projectile 116 into the central pipe 120 during operation. As illustrated, the ball guide 118 may include one or more sidewalls that are angularly sloped, such that a wellbore projectile 116 may be guided by gravity towards an entrance opening of the central pipe 120.

In some embodiments, the ball guide 118 may further include one or more motors 214 positioned at or near an upper surface or the opening of the ball guide 118. In other embodiments, the motors 214 may be positioned at a bottom of the ball guide 118 near the entrance opening to the central pipe 120. In some embodiments, the motors 214 may be low-torque DC motors which may generate rotation within the ball guide 118. The motors 214 may each be mated to a wheel 216, which may be mated to an axle or drive shaft of the respective motor 214. The wheels 216 may be formed or otherwise coated in a rubber or silicone material such that the wheels 216 may grip and propel the wellbore projectile 116 downwardly and into the ball guide 118. As such, the wheels 216 powered by the motors 214 may propel a wellbore projectile 116 downwardly as the projectile 116 is placed into the ball guide 118, or as the projectile 116 approaches the central pipe 120 within the ball guide 118. As a result, the wellbore projectile 116 may be more efficiently accelerated into and through the central pipe 120 towards the joint 122.

The motors 214 and wheels 216 may enable the wellbore projectile 116 to overcome any resistance entering into the high-pressure lines 110*a-c* of FIG. 1 via the joint 122. For example, the joint 122 may become obstructed by sand or other materials pumped through the high pressure lines 102*c,a*, and a speed of the motors 214 may be adjusted to permit the projectile 116 to penetrate the obstruction without damaging the joint 122.

The ball guide 118 may further include one or more power sources 218 mounted to the ball guide 118, either within the ball guide 118 or externally located. The power sources 218 may provide electrical power to the motors 214 for operation. In at least one embodiment, the power sources 218 may be independent of other power sources for powering the pump "P" (FIG. 1) or other hydraulic fracturing equipment. In such embodiments, the power sources 218 may include lithium-ion batteries or nickel-cadmium batteries which may provide power to the motors 214. In alternate embodiments, however, the power sources 218 may be electrical cables or other power conduits connected to external power sources such as a generator (not shown).

The ball drop apparatus 114 may further include one or more gate valves 220 coupled in series within the central pipe 120. In the illustrated embodiment, the gate valves 220 are coupled within the generally horizontal portion of the central pipe near the joint 122. In other embodiments, one or more of the gate valves 220 may be arranged above the elbow 202 in the generally vertical portion of the central pipe 120. The gate valves 220 may be closed while the pump "P" (FIG. 1) is operating to pump fluid through the high-pressure lines 110*a-c* (FIG. 1) in fluid communication with the joint 122. While pumping, the gate valves 220 may prevent backflow of fluids into the ball drop apparatus 114 as an available outlet.

The gate valves 220 may be opened prior to dropping a wellbore projectile 116 through the ball guide 118, such that the wellbore projectile 116 may enter the joint 122 without impedance. In some embodiments, the one or more gate valves 220 may comprise 3 inch by 3 inch gate valves to mate with the 3 inch outer diameter pipes utilized in the ball drop apparatus 114, the high-pressure lines 110*a-c* and other related hydraulic fracturing equipment.

The joint 122 may further include threading 222 on opposing ends (arms) of the T-shaped joint 122, such that the joint 122 may be threadably mated with the high-pressure lines 110*a-c* (FIG. 1). While the threading 222 is illustrated as internal threading on one end and external threading on the other, those skilled in the art will readily appreciate that the threading 222 may be externally or internally located on both sides of the joint 122 for mating with threads of the high-pressure lines 110*a-c*, without departing from the scope of this disclosure.

Figure 3:
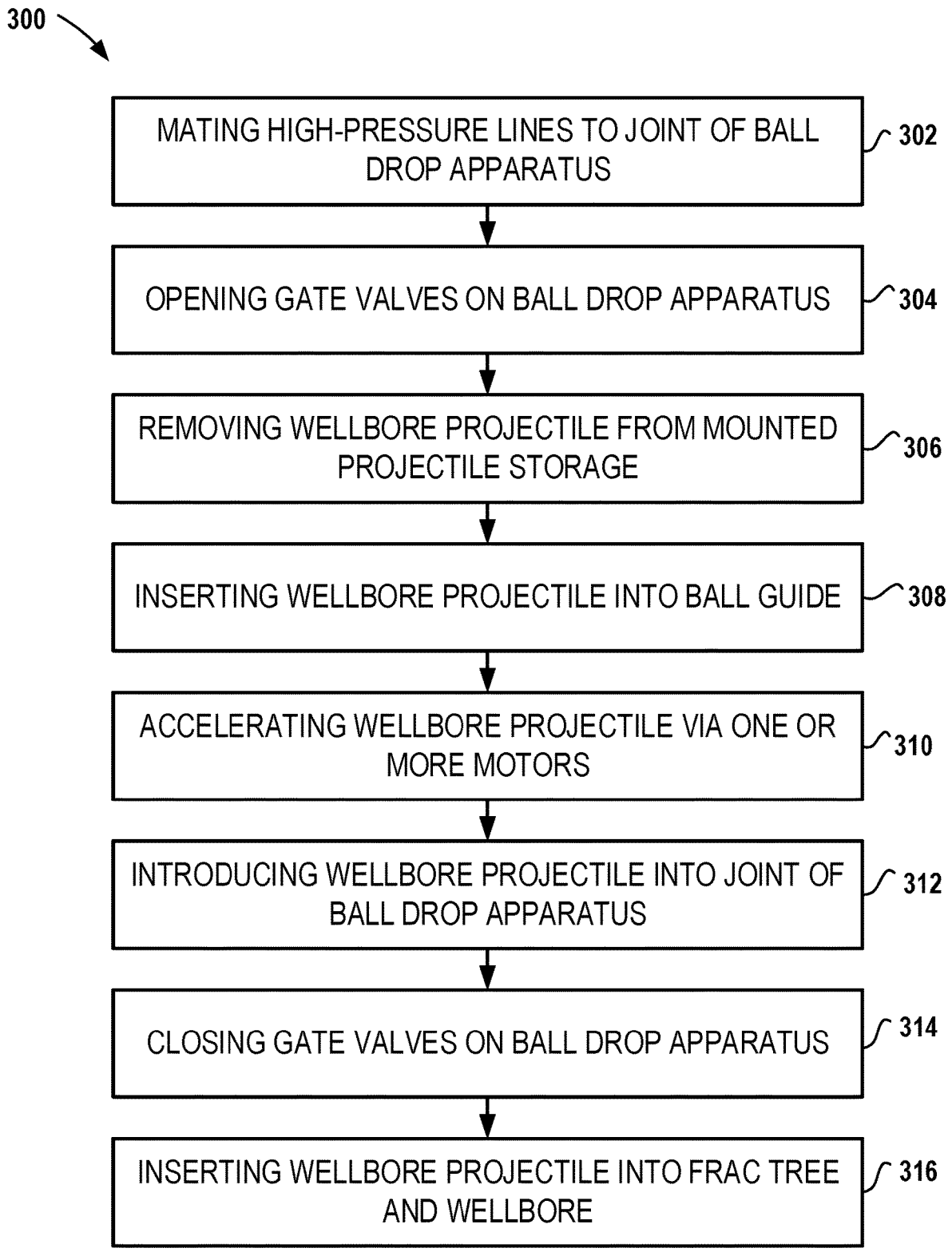
FIG. 3 is a flowchart illustrating an example method for introducing a wellbore projectile into a wellbore.

FIG. 3 is a flowchart of an example method 300 for introducing a wellbore projectile into a wellbore. The method 300 may begin at 302 with mating one or more high-pressure lines (e.g., the high-pressure lines 110*a-c* of FIG. 1) to a joint (e.g., the joint 122 of FIGS. 1-2) of a ball drop apparatus (e.g., the ball drop apparatus 114 of FIGS. 1-2). The one or more high-pressure lines may be mated to the joint of the ball drop apparatus via one or more threaded connections (e.g., the threading 222 of FIG. 2) on the joint, such that a seal is generated between the ball drop apparatus and the high-pressure lines at ground level. Once the high-pressure lines are mated to the joint, hydraulic fracturing fluid may be pumped through the high-pressure lines and the joint. Pumping may be paused and the method 300 may continue at 304 with opening of one or more gate valves (e.g., the gate valves 220 of FIG. 2) to enable communication between the joint and the remainder of the ball drop apparatus. The gate valves may be opened at 304 as pumping is paused.

The method 300 may continue at 306 with removing a wellbore projectile from a mounted projectile storage compartment (e.g., the projectile storage compartment 212 of FIG. 2). The mounted projectile storage compartment may be located on the ball drop apparatus, such that the wellbore projectile is readily accessible to an operator during the method 300. The method 300 may continue at 308 with inserting the wellbore projectile into the ball guide (e.g., the ball guide 118 of FIGS. 1-2). The ball guide may be sloped or slanted, such that the wellbore projectile may be guided towards an entrance opening of a central pipe (e.g., the central pipe 120 of FIGS. 1-2).

The method 300 may continue at 310 with accelerating the wellbore projectile via one or both motors (e.g., the motors 214 of FIG. 2). The one or more motors may be positioned near an opening of the ball guide or near a connection between the ball guide and the central pipe of the ball drop apparatus. The one or more motors may each be mated to a wheel (e.g., the wheels 216 of FIG. 2) such that torque of the motors may be transferred to a wheel for accelerating the wellbore projectile. In some embodiments, the wheels may be formed of, or coated in, a rubber or silicone material for generating friction and gripping the wellbore projectile. The one or more motors may assist gravitational forces in accelerating the wellbore projectile towards and into the central pipe of the ball drop apparatus.

The method 300 may continue at 312 with introducing the wellbore projectile into the joint of the ball drop apparatus. As the wellbore projectile accelerates through the central pipe of the ball drop apparatus, the wellbore projectile may translate from vertical to lateral motion via an elbow (e.g., the elbow 202 of FIG. 2) in the central pipe. The lateral motion may enable the wellbore projectile to travel through the one or more gate valves and into the joint of the ball drop apparatus. The method 300 may continue at 314 with closing of the one or more gate valves of the ball drop apparatus, such that pumping may resume through the high-pressure lines. The closing of the gate valves may prevent backflow into the ball drop apparatus, and may limit available flowpaths for the wellbore projectile. Accordingly, resuming pumping may push the wellbore projectile into the high-pressure lines and towards the frac tree (e.g., the frac tree 106 of FIG. 1). As such, the method 300 may continue at 316 with inserting the wellbore projectile into the frac tree, and accordingly into the wellbore below. The pumping of the hydraulic fluid through the high-pressure lines may carry the wellbore projectile into a fracturing head (e.g., the fracturing head 108 of FIG. 1) and thus into the frac tree. The hydraulic fluid may be pumped into the wellbore and the wellbore projectile may travel into the wellbore, such that it may be seated onto a downhole tool for performance of plug and perf operations. As such, a plug and perf operation may be performed from ground level without the need for lifting equipment or modification to the wellbore or fracturing tree.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A projectile introduction system, comprising:

a central pipe configured to receive and guide a wellbore projectile therethrough at ground level;

a ball guide mated to a top end of the central pipe and including at least one sloped surface for guiding the wellbore projectile into the central pipe;

a T-shaped joint including connections on opposing arms and in fluid communication with a bottom end of the central pipe; and at least one high-pressure line extending between a pump and a wellbore frac tree, wherein the connections on the opposing arms of the T-shaped joint are mated with the at least one high-pressure line, and wherein the central pipe extends in a vertical downward direction from the ball guide.

2. The projectile introduction system of claim 1, further comprising a support frame secured to the central pipe to support the central pipe at ground level.

3. The projectile introduction system of claim 2, further comprising a projectile storage mounted to the support frame for storing a plurality of wellbore projectiles.

4. The projectile introduction system of claim 1, wherein the ball guide further includes one or more wheels operable to accelerate the wellbore projectile into the central pipe.

5. The projectile introduction system of claim 4, wherein the one or more wheels are operated by a corresponding one or more motors.

6. The projectile introduction system of claim 5, wherein the ball guide further includes one or more power sources electrically coupled to the one or more motors.

7. The projectile introduction system of claim 6, wherein the one or more power sources comprise a battery.

8. The projectile introduction system of claim 1, further comprising one or more gate valves coupled within the central pipe and operable to prevent flow from the at least one high-pressure line into the central pipe.

9. The projectile introduction system of claim 1, wherein the central pipe and the T-shaped joint are formed of three-inch outer diameter pipe to enable mating with the at least one high-pressure line.

10. The projectile introduction system of claim 1, wherein the central pipe includes an elbow defining a transition from a vertical orientation at the top end of the central pipe to a horizontal orientation at the bottom end of the central pipe.

11. The projectile introduction system of claim 1, wherein the elbow rests at ground level.

12. The projectile introduction system of claim 11, further comprising a lateral bar protruding from the elbow to increase surface area of the projectile introduction system resting at ground level.

13. A method, comprising:

mating one or more high-pressure lines extending between a pump and a frac tree to a T-shaped joint of a ball drop apparatus at ground level;

introducing a wellbore projectile into a ball guide in communication with a central pipe of the ball drop apparatus, the central pipe extending in a generally vertical downward direction from the ball guide;

conveying the wellbore projectile into the high-pressure lines through the central pipe and the T-shaped joint; and conveying the wellbore projectile into the frac tree via the high-pressure lines and a fracturing head of the frac tree.

14. The method of claim 13, further comprising accelerating the wellbore projectile into the central pipe using one or more wheels rotatably mounted to the ball guide.

15. The method of claim 13, wherein introducing the wellbore projectile into the ball guide is preceded by removing the wellbore projectile from a projectile storage mounted to the ball drop apparatus.

16. The method of claim 13, further comprising opening one or more gate valves coupled within the central pipe of the ball drop apparatus to enable the wellbore projectile to enter the one or more high-pressure lines from the ball drop apparatus.

17. The method of claim 16, further comprising:

closing the one or more gate valves of the ball drop apparatus following introduction of the wellbore projectile into the high pressure lines; and pumping fluid through the one or more high-pressure lines to propel the wellbore projectile through the one or more high pressure lines.

18. The method of claim 13, wherein mating the one or more high-pressure lines to the T-shaped joint includes threadably coupling the one or more high-pressure lines to threads defined within the T-shaped joint.

19. The method of claim 13, wherein the ball drop apparatus includes a height between about one foot and about six feet from ground level.

20. The method of claim 13, wherein the one or more high-pressure lines include first and second high-pressure lines, the method further comprising:

mating the first high-pressure line extending from the pump to a first arm of the T-shaped joint; and mating the second high-pressure line extending to the frac tree to a second arm of the T-shaped joint.

* * * * *